United States Patent [19]

Kausträter et al.

[11] Patent Number: 4,966,064

[45] Date of Patent: Oct. 30, 1990

[54] ARMOURED CAR

[75] Inventors: Gert Kausträter; Josef Jörg, both of Augsburg; Helmut Janda, Schwabmünchen, all of Fed. Rep. of Germany

[73] Assignee: Kuka Wehrtechnik GmbH, Augsburg, Fed. Rep. of Germany

[21] Appl. No.: 467,752

[22] Filed: Nov. 17, 1989

Related U.S. Application Data

[63] Continuation of Ser. No. 141,302, Jan. 6, 1988, abandoned.

[30] Foreign Application Priority Data

Jan. 16, 1987 [DE] Fed. Rep. of Germany ..... 3701091

[51] Int. Cl.[5] ..... F41A 9/09

[52] U.S. Cl. ..... 89/46

[58] Field of Search ..... 89/45, 46, 47, 36.13

[56] References Cited

U.S. PATENT DOCUMENTS

| | | | |
|---|---|---|---|
| 1,565,837 | 12/1925 | Webster | 89/45 |
| 2,971,438 | 2/1961 | Fox | 89/45 |
| 3,075,434 | 1/1963 | Hickman et al. | 89/45 |
| 4,495,853 | 1/1985 | Gottwaldt | 89/46 |
| 4,648,305 | 3/1987 | Elspass | 89/45 |
| 4,671,164 | 6/1987 | DeHaven et al. | 89/45 |
| 4,700,609 | 10/1987 | Wiethoff et al. | 89/45 |

FOREIGN PATENT DOCUMENTS

| | | | |
|---|---|---|---|
| 3042675 | 6/1982 | Fed. Rep. of Germany | 89/45 |
| 3111514 | 10/1982 | Fed. Rep. of Germany | 89/45 |
| 3631796 | 4/1987 | Fed. Rep. of Germany | 89/45 |

*Primary Examiner*—Charles T. Jordan
*Assistant Examiner*—Stephen Johnson
*Attorney, Agent, or Firm*—Antonelli, Terry, Stout & Kraus

[57] ABSTRACT

An armoured car or vehicle with front wheel drive has a vehicle hull and a turret with gun, as well as a front revolving magazine located on the bottom of the turret platform in the vicinity of the gun for large caliber ammunition inserted in upright form. In order to be able to carry maximum ammunition stocks within the vehicle and ensure a mechanized, automatic ammunition flow, on the bottom of the vehicle hull behind the front revolving magazine is provided a rear revolving magazine largely filling the rear vehicle space and receiving the ammunition in standing form and between the two revolving magazines is provided a transfer mechanism occupying an empty position on the front revolving magazine from the rear revolving magazine.

14 Claims, 3 Drawing Sheets

ARMOURED CAR

This is a continuation of application Ser. No. 141,302, filed Jan. 6, 1988 now abandoned.

BACKGROUND OF THE INVENTION

The invention relates to an armoured car with front wheel drive, which has a vehicle hull or body, a turret with gun, and a front revolving magazine positioned in a vicinity of the gun on a bottom of the turret platform for upright inserted, large calibre ammunition.

Nowadays, scarcely any problems are caused in connection with supplying a weapon of an armoured car with small calibre ammunition. This small calibre ammunition is lined up, e.g. on belts, transported, which can be conveyed and deflected in random directions by corresponding guides. The belts form both the holders and the transportation means for the ammunition. However, due to weight and size, large calibre ammunition cannot be conveyed by using belts. Thus, with large caliber ammunition it has largely been necessary to manually transport and load the gun, i.e. use has had to be made of manpower. Quite apart from the physical strain, this generally also requires a corresponding free space within the armoured vehicle and in addition there are human errors which cannot be avoided.

Therefore numerous attempts have been made to store large calibre ammunition within the vehicle or car. Thus, for example, it is known to house large calibre ammunition in the rear of the vehicle turret in such a way that via an index position it can be automatically transferred into the weapon. As a result of the restricted space in the gun turret, only a limited supply of ammunition can be stored there. Moreover the turret magazine must be manually filled from the vehicle hull or from the outside.

It is also known (German Pat. No. 36 27 042) to arrange on the turret platform below the gun turret a rotary or revolving magazine in the form of a pitch circle-like loop and to provide a loading mechanism in a vicinity of the gun which receives the ammunition housed in standing manner in the magazine and bring the same, via corresponding movement sequence, into the gun barrel bore axis. This revolving magazine makes it possible to store a large amount of ammunition in the vicinity of the gun, as well as an automatic removal and transfer of the ammunition at the gun. However, this revolving or rotary magazine must also be manually refilled from the rear of the vehicle and each individual magazine position must be separately occupied with a round.

The aim underlying the present invention essentially resides in providing an armoured vehicle of the aforementioned type with a mechanized and largely automatic ammunition flow within the armoured vehicle and with maximum ammunition storage capabilities.

In accordance with advantageous features of the invention on the bottom of the vehicle hull behind the front, turret-side revolving magazine is positioned a hull-side revolving magazine receiving the ammunition in upright position and largely filling the rear vehicle space and between the two revolving magazines is provided a transfer mechanism occupying empty positions at the front revolving magazine from the rear revolving magazine.

The invention makes use of the fact that with armoured cars with front wheel drive, the hull is largely free from components behind the gun. According to the invention use is made of this free space as a correspondingly large ammunition storage in that on the bottom of the vehicle or car hull is provided a rear, hull-side revolving magazine, which can receive a larger amount of ammunition and from which the ammunition can be transferred by the transfer mechanism into the turret-side revolving magazine. The latter can be controlled in such manner that after each shot or after a few shots the empty positions are moved into the vicinity of the transfer mechanism, where they are again occupied with new ammunition from the hull-side revolving magazine, so that the turret-side revolving magazine always contains sufficient ammunition for a combat function.

In a preferred embodiment of the invention, the hull-side revolving magazine has a plurality of smaller magazine units, which are interchangeably placed in the revolving magazine and driven in such a way that, in conjunction with the driving movement of the hull-side revolving magazine, each position of the magazine unit can be moved into the movement path of the transfer mechanism.

This inventive measure makes it possible to simply resupply with ammunition the hull-side revolving magazine. The large calibre ammunition can be made available in the small magazine units, introduced into the vehicle and inserted in the hull-side revolving magazine. This permits a rapid and simple resupplying with ammunition of the hull-side revolving magazine. The revolving magazine can obviously be also individually resupplied with ammunition.

According to a further advantageous development, the hull-side revolving magazine is constructed in circular manner with a central drive and has on a circle a plurality of rotary receptacles for in each case one magazine unit.

Thus, according to this embodiment, the rear revolving magazine is constructed in the manner of a large turntable and this in turn carries several smaller magazine units in the form of turntables. The driving movements of both the revolving magazine and the magazine units are circular movements which can be particularly easily realized from the drive standpoint.

To ensure even better space utilization, in the vicinity of the periphery of the circular, hull-side revolving magazine and between the rotary receptacles for in each case one magazine unit, individual receptacles are provided for in each case one shell, which are arranged on the same circle as the magazine unit shell located closest to the periphery.

Preferably, each magazine unit is constructed as a pallet on which the rounds are arranged in circular upright manner. Each magazine unit has a transport holder permitting problem-free handling from the munitions factory to the armoured car.

Appropriately in the vicinity of the rear of the vehicle is provided a loading door or flap, the hull-side revolving magazine having a holding position in the vicinity of the loading door or flap. The latter can either be opened to the rear or top, so that the magazine units can be introduced from the rear or top into the vehicle hull and can be inserted into the revolving magazine.

According to another advantageous embodiment, the transfer mechanism comprises a transfer arm mounted on a vertical shaft with at least one gripper for a shell, and the transfer arm can be pivoted between a reception position on the hull-side revolving magazine and a delivery position on the turret-side revolving magazine.

The two revolving magazines are preferably arranged in such a way that their outer movement paths are approximately in contact at one point, so that in this manner the maximum amount of ammunition can be stored. In the vicinity of the maximum approximation of the revolving magazines is preferably arranged the transfer mechanism, so that the transfer of the ammunition from the hull-side into the turret-side revolving magazine takes place over the shortest path with the minimum time requirement.

The transfer arm can be arranged on a vertical column having the shaft and fixed to the vehicle hull. The transfer arm can also be fixed to a sliding carriage having a shaft and which is horizontally displaceable between a hull-side and the turret-side revolving magazine on a guide on the vehicle hull, preferably the side wall thereof. The latter construction is advantageous if the two revolving magazines cannot be brought too close together as a result of the space conditions or the space needed for the crew and, consequently, a larger transfer path must be bridged.

Advantageously the two revolving magazines and the transfer mechanism are so linked by a control that, on entering an empty position on the turret-side revolving magazine in the delivery position of the transfer mechanism, there is always an occupied position on the hull-side revolving magazine in the reception position. This permits a delay-free refilling with ammunition of the front revolving magazine.

According to the aforementioned known proposal (German Pat. No. 36 27 042), the front revolving magazine can be provided with different types of large calibre ammunition, e.g. explosive ammunition or incendiary ammunition. In this case, according to the invention, the hull-side revolving magazine has magazine units with correspondingly varied ammunition, so that the turret-side revolving magazine can be supplied, as desired, with one or other ammunition type.

It is advantageous if the different types of ammunition and/or the magazine units receiving them are provided with sensors indicating the ammunition type, the control system having means for inserting the desired ammunition type from the hull-side revolving magazine at an empty position of the turret-side revolving magazine. This makes it possible to refill the turret-side revolving magazine from the hull-side revolving magazine, as a function of the ammunition fired.

The invention is described in greater detail hereinafter relative to two embodiments and the attached drawings.

Figure 1:
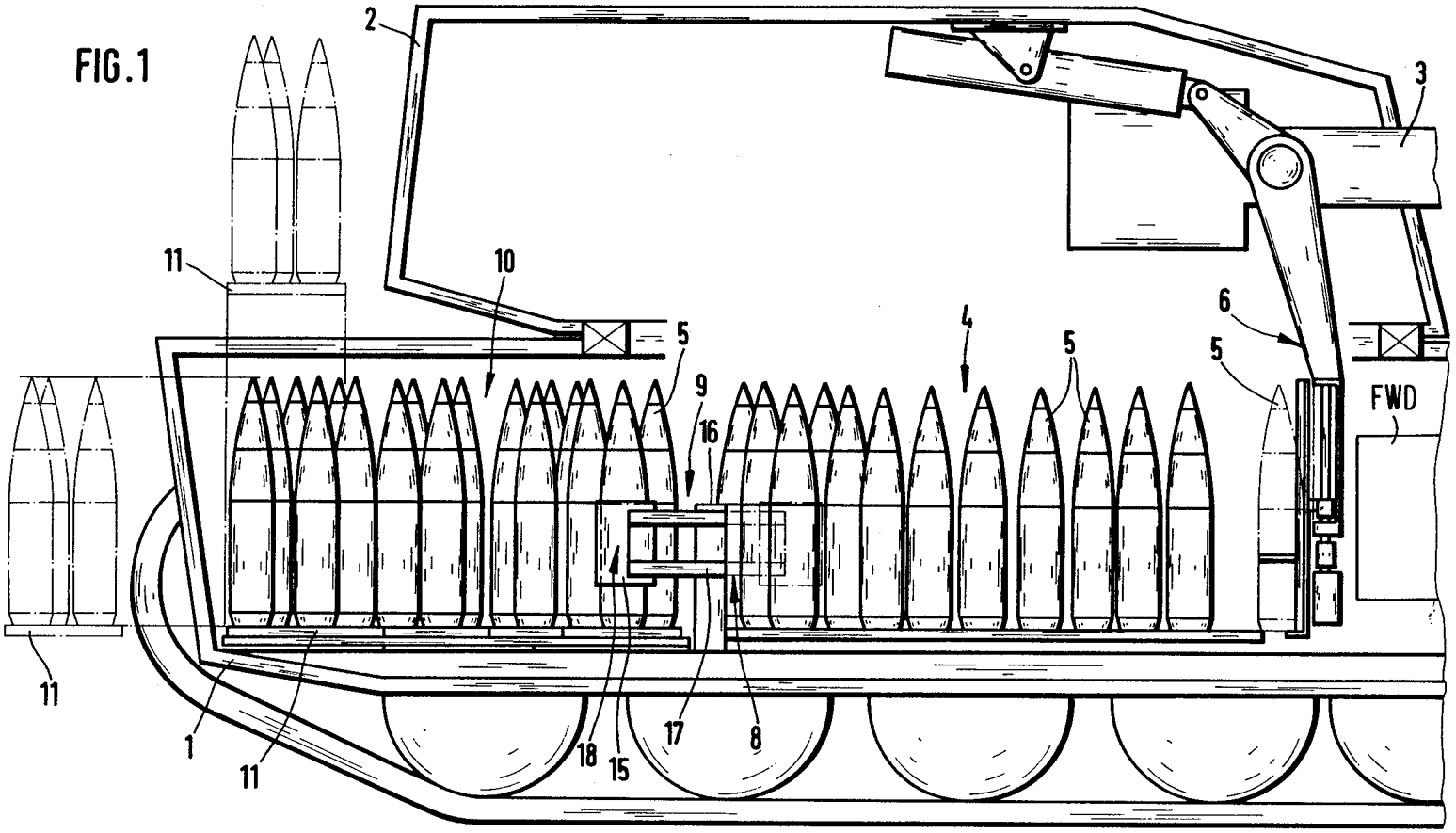
FIG. 1 is a schematic partly broken away section through an armoured car constructed in accordance with the present invention.

The armoured car or vehicle diagrammatically represented in FIG. 1 include an armoured hull 1 an a gun turret 2 with a gun 3 mounted in rotary manner on a hull 1 and a front wheel drive means (not shown). On the bottom of the turret platform in the vicinity of the gun turret 2 is provided a front revolving generally designated by the reference numeral 4, from which the large calibre shells or rounds 5 can be removed by a loading mechanism generally designated by the reference numeral 6 and supplied to the gun 3.

Figure 2:
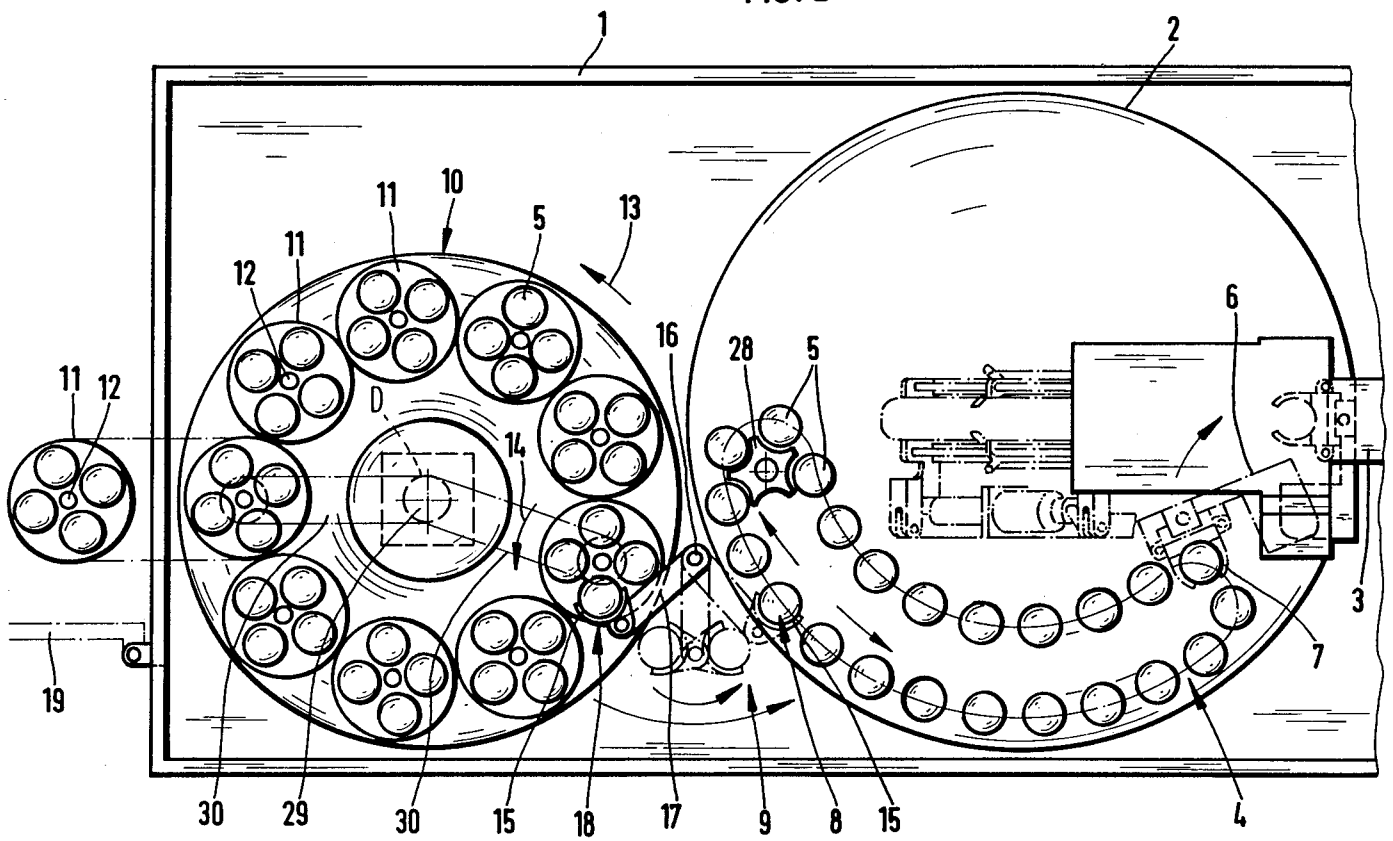
FIG. 2 is a plan view of an armoured car hull.

As shown in FIG. 2, the front revolving magazine 4 is constructed in a pitch circle-like loop which, as is indicated by the arrows, can be by a drive means (not shown) in both directions, namely between a position 7 for the loading mechanism 6 (removal) and a transfer position generally designated by the reference numeral 8 (reception) of a transfer generally designated by the reference numeral 9.

Figure 3:
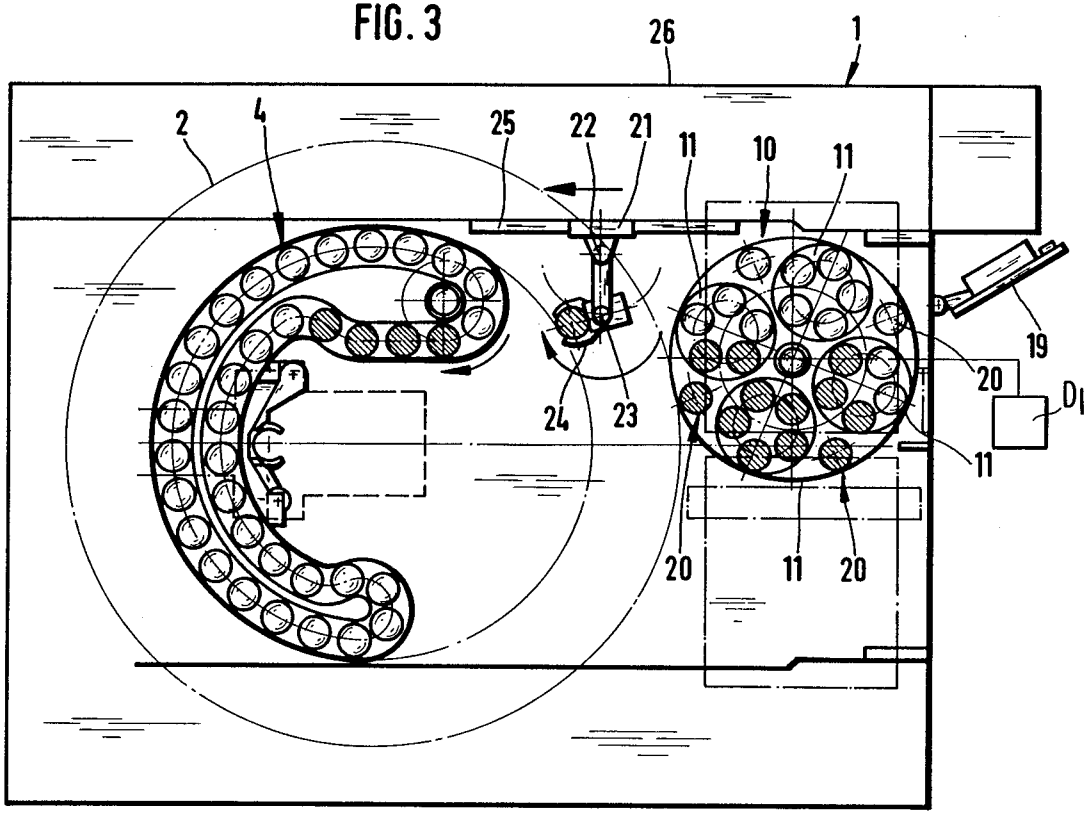
FIG. 3 is a plan view of a modified armoured car hull constructed in accordance with the present invention.

In a rear area of the vehicle hull 1 and directly connecting onto the front revolving magazine 4 is provided a rear revolving magazine generally designated by the reference numeral 10 FIG. 3, which in the illustrated embodiment is constructed as a centrally driven revolving magazine with a driving means (not shown). The rear revolving magazine 10 is provided on an outer arrangement circle with a plurality of smaller rotary pallet-like magazine units generally designated by the reference numeral 11, which are once again circular and, in the illustrated embodiment, receive in each case four rounds or shells. These smaller magazine units 11 are constructed in the form of circular pallets, which can be driven in their center 12 by driving means (not shown).

By the rotary movement of the rear revolving magazine indicated by arrow 13 FIG. 2 and the rotary movement of the pallet-like magazine units indicated by arrow 14 FIG. 2 each round on the magazine units 11 can be moved into a reception position generally designated by the reference number 18, where it is gripped by the transfer mechanism 9 and transferred into the transfer position 8 on the front revolving magazine 4.

The transfer mechanism 9 in the illustrated embodiment comprises a vertical column 16 and a horizontal arm 17 mounted thereon with a gripper 15, which grasps the shell circumference and secures the same and transfers the shell from the reception position 18 shown in continuous line form into the transfer position 8, shown in broken line form, on the front revolving magazine 4.

Optionally the pallet-like magazine units 11 can receive different types of large calibre ammunition in order to be able to fire different ammunition types. Furthermore, the front revolving magazine 4, rear revolving magazine 10 and transfer mechanism 9 are so interlinked from the control standpoint that on entering an empty position on the front revolving magazine 4 in the transfer position 8, there is a corresponding occupied position available on the rear revolving magazine 10 at the reception position 18, so that the round located there can be transferred by the transfer mechanism into the front revolving magazine 4.

In the case of different types of ammunition, both the shells and also a corresponding number of positions in the front revolving magazine 4 can be provided with suitable sensors, e.g. in order to ensure that only one shell type can be inserted in the specified positions of the front revolving magazine 4. However, instead of this it is also possible to so control the two revolving magazines 4, 10 from the gun control system, that the ammunition required by the gun 3 is made available in the corresponding order in revolving magazine 4.

As shown in FIG. 2, in the vicinity of a rear of the vehicle there is an either rearwardly opening loading door 19, or an upwardly opening and loading flap, (not shown) through which the pallet-like magazine units 11 can be introduced into the vehicle hull 1 and placed on corresponding receptacles of the rear revolving magazine 10. The shells can be placed on the empty pallet-like magazine units 11 in the munitions factory or behind the front. These pallet-like magazine units 11 have a transport holder, (not shown) which is e.g. positioned in the 12 of the pallet and by which the magazine units 11 can be grasped and transported.

In the embodiment of FIG. 3 identical or functionally identical parts are given the same reference numerals. In the front region below the gun 3 the turret-side revolving magazine is drawn round, while the space behind the gun 3 is made more readily accessible for the crew. The hull-side magazine 10 is moved somewhat further to the rear and is smaller than in the embodiment of FIG. 2. Between the rotary magazine units 11, it has individual receptacles or supports generally designed by the reference numeral 20 for shells, which fill the empty space between the magazine units 11.

In place of the column 16 of FIG. 2, the transfer mechanism has a sliding carriage 21, on which the transfer arm 17 is mounted on a shaft 22. The transfer arm 17 is provided at its free end with a shaft 23, on which can be pivoted the gripper 24. The sliding carriage 21 can be moved along a guide 25 positioned on the side wall 26 of hull 1.

The inventive construction ensures a mechanized and largely automatic ammunition flow within an armoured vehicle accompanied by the maximum possible ammunition supply. It is also possible to largely mechanize the resupplying with ammunition.

We claim:

1. Armoured vehicle comprising a front wheel drive means, a vehicle hull, a turret means with a gun means, a first revolving magazine means for accommodating upright inserted large calibre rounds of ammunition arranged at a front of the vehicle along a bottom of a platform of the turret means in a vicinity of the gun means, a second revolving magazine means substantially filling a rear space of the vehicle for receiving rounds of ammunition in an upright position and a transfer means arranged in an empty space of the vehicle between said first revolving magazine means and said second revolving magazine means for transferring the rounds of ammunition from said second revolving magazine means to said first revolving magazine means, and wherein said second revolving magazine means includes a plurality of individual magazine units with each individual magazine unit accommodating a plurality of rounds of ammunition.

2. Armoured vehicle according to claim 1, wherein said plurality of individual magazine units are interchangeably insertable in said second revolving magazine means and are synchronously driven in conjunction with a driving movement of the second revolving magazine means such that each round of ammunition of the plurality of rounds of ammunition accommodated by the respective individual magazine units can be brought into a movement path of said transfer means.

3. Armoured vehicle according to one claims 1 or 2, wherein said second revolving magazine means has a circular configuration and a central drive means, and a plurality of circumferentially spaced rotary supports for supporting the rounds of ammunition accommodated by the respective individual magazine units.

4. Armoured vehicle according to claim 3, wherein individual receptacle means are disposed about a periphery of said second revolving magazine means and arranged on the same circle as a round of ammunition of the respective individual magazine units nearest to the periphery of the second revolving magazine means.

5. Armoured vehicle according to claims 1 or 2, wherein each individual magazine unit includes a pallet means having the plurality of rounds of ammunition arranged thereon in a circular manner.

6. Armoured vehicle according to one of claims 1 or 2, wherein each individual magazine unit includes a transport holder.

7. Armoured vehicle according to claim 1, comprising a loading door means provided in the vehicle hull for enabling a loading of the rounds of ammunition, and wherein said second revolving magazine means has a holding position located in a vicinity of the loading door means.

8. Armoured vehicle according to claim 1, wherein the transfer means comprises a transfer arm mounted on a vertical shaft with at least one gripper means for gripping a round of ammunition, and wherein the transfer arm is pivotable between a reception position on the second revolving magazine means and a delivery position on the first revolving magazine means.

9. Armoured vehicle according to claim 8, wherein the transfer arm is located on a vehicle column having the vertical shaft and fixed to the vehicle hull.

10. Armoured vehicle according to claim 8, wherein the transfer arm is located on a sliding carriage having the vertical shaft and is movable horizontally between the second revolving magazine means and the first revolving magazine means on a guide on the vehicle hull.

11. Armoured vehicle according to claim 10, wherein the guide is provided on a side wall of the vehicle hull.

12. Armoured vehicle according to claim 1, wherein the first revolving magazine means and the second revolving magazine means and the transfer means are interconnected by a control means in such a manner that upon entering an empty position on the first revolving magazine means in a delivery position of the transfer means, an occupied position on the second revolving magazine means is always available in a reception position.

13. Armoured vehicle according to claim 1 with a first revolving magazine means for different types of large calibre ammunition, wherein the second revolving magazine means includes individual magazine units with correspondingly varied types of large calibre ammunition.

14. Armoured vehicle according to claim 1, wherein at least one of the different types of large calibre ammunition and individual magazine units for receiving the same are provided with sensor means for indicating a type of ammunition, and wherein control means are provided for inserting a desired type of ammunition from the second revolving magazine means at an empty position of the first revolving magazine means.

* * * * *